United States Patent [19]

Lare

[11] 4,049,493

[45] Sept. 20, 1977

[54] SELF-BONDING SYNTHETIC WOOD PULP AND PAPER-LIKE FILMS THEREOF AND METHOD FOR PRODUCTION OF SAME

[75] Inventor: Donald W. Lare, Hamilton, Ohio

[73] Assignee: Champion International Corporation, Stamford, Conn.

[21] Appl. No.: 603,328

[22] Filed: Aug. 11, 1975

Related U.S. Application Data

[63] Continuation-in-part of Ser. No. 496,095, Aug. 9, 1974, abandoned.

[51] Int. Cl.[2] ..... D21F 11/00

[52] U.S. Cl. ..... 162/157 R; 162/146; 162/182; 264/140

[58] Field of Search ..... 162/182, 146, 102, 157 R; 260/29.6 WA, 94 B, 29.6 WB, 897 B; 264/DIG. 8, 140, 141, 147

[56] References Cited

U.S. PATENT DOCUMENTS

| | | | |
|---|---|---|---|
| 2,999,788 | 9/1961 | Morgan | 162/157 R |
| 3,743,570 | 7/1973 | Yang et al. | 162/157 R |
| 3,849,387 | 11/1974 | Fowells et al. | 162/157 R |
| 3,855,056 | 12/1974 | Maeda et al. | 162/157 R |
| 3,920,507 | 11/1975 | Yonemori | 162/157 R |
| 3,920,508 | 11/1975 | Yonemori | 162/157 R |
| 3,920,509 | 11/1975 | Yonemori | 162/157 R |
| 3,960,794 | 6/1976 | Sander et al. | 162/157 |

*Primary Examiner*—S. Leon Bashore
*Assistant Examiner*—Peter Chin
*Attorney, Agent, or Firm*—Evelyn M. Sommer

[57] ABSTRACT

Synthetic wood pulp characterized by the presence of polyolefin fibrids having both film and fiber morphology is disclosed as being useful for the production of paper-like films. Further disclosed is a technique whereby this morphology may be preserved by transferring such fibrids from the refining dispersant into a preservative medium. After again being refined in the preservative medium, the fibrids can be formed directly into paper-like substrate products. More usually, however, they are first dispersed in water to facilitate this casting.

10 Claims, No Drawings

SELF-BONDING SYNTHETIC WOOD PULP AND PAPER-LIKE FILMS THEREOF AND METHOD FOR PRODUCTION OF SAME

RELATED APPLICATIONS

This is a continuation-in-part of application Ser. No. 496,095 filed Aug. 9, 1974 now abandoned.

BACKGROUND OF THE INVENTION

Synthetic wood pulp has long been recognized in the prior art as being particularly useful for the production of paper-like substrates. Such pulp, which ordinarily consists essentially of fibrils or short lengths of polymeric fibers, has long been known to be useful as a replacement for wood pulp and, in particular, to be susceptible to formation into synthetic wood products in essentially the same manner as has been utilized for natural wood pulp.

The production of these fibrils has normally been performed through steps comprising refining solid polyolefinic fiber in organic dispersant under conditions of high shear stress followed by the replacement of the original dispersant—either directly or by means of one or more intermediate liquid media—with water so as to form an essentially aqueous slurry of the polyolefin.

The prior art is replete with techniques for the initial production of suitable polymeric fibers. Ordinarily, such fibers are formed in a liquid hydrocarbon by techniques, the most notable of which are fiber spinning, shear precipitation and thermal precipitation. Representative of these suitable hydrocarbons are: aromatics—such as benzene, toluene; aliphatics—such as butane, hexane, octane; alicyclics—such as cyclohexane; and halogenated aliphatics—such as methylchloride, carbontetrachloride.

By way of example, fibers have been formed by ejecting hydrocarbon solution of polyolefin through spinnerets to form continuous filaments as in U.S. Pat. No. 3,081,519, while in U.S. Pat. No. 3,743,272 there is disclosed a process whereby high molecular weight polyolefin may both be produced in a hydrocarbon and formed into fibers upon subsequent precipitation of the polymer therefrom by cooling.

The particular means by which the initial polymer fibers are formed is not, however, critical. What is important is that in essentially all the prior art processes, solid polyolefinic fibers having molecular weights in excess of 200,000 and ordinarily in excess of 500,000 are produced in a hydrocarbon vehicle. The conversion of these fibers to useful form may be accomplished by subjecting a slurry of the fibers to high shear stress. The minimum shear stress required for the formation of such structures depends somewhat upon the particular polymer and medium utilized. It is well known within the ordinary skill in the art, however, to determine the necessary conditions of, for example, agitator velocity and angle of incidence which are necessary for the production of a pulp useful, inter alia, for the production of paper and paper-like structures.

Numerous refining media for dispersing the fibers are also known in the prior art. One such technique simply utilizes the liquid hydrocarbon in which the fibers are originally formed. More commonly, however, it is desired first to transfer such fibers to a second medium for fibrid production. Accordingly, the initial hydrocarbon dispersant is ordinarily replaced with an organic solvent miscible therewith so as both to facilitate the transfer and simultaneously to purify the fibers of such hydrocarbon which generally exhibits disagreeable properties.

After formation of useful fiber pulp—either in the initial hydrocarbon solvent or in one of the usual replacement media therefor—it is desirable to convert it to an essentially aqueous slurry. Accordingly, the refining medium which disperses refined polymer may be replaced with water to facilitate production of paper and paper-like films in the same manner, and on the conventional equipment, utilized in the production of paper from aqueous wood pulp slurries.

DESCRIPTION OF THE INVENTION

It is an object of the present invention to produce a synthetic wood pulp comprising solid polyolefin fibrids which are particularly useful in the production of synthetic wood products.

More particularly, it has been discovered that certain polyolefinic fibrids characterized by the combination of both a film and fiber morphology exist and can be used to produce unusually high quality paper and paper-like films.

The present invention revolves about the discovery that the refining of solid polyolefin fiber in organic dispersant for the purpose of producing synthetic wood pulp results in a product having a clearly identifiable combination of both film and fiber morphology.

By "combination of both film and fiber morphology," it is meant that the resultant fibrids are of a physical orientation such that they are composed of discrete portions of ultra-thin transparent films and of fibrils or short fibers. This bipartite morphology is the inherent result of the application of high shear stress to the original solid polyolefin fibers in the presence of an organic refining dispersant. Such fibrids are—as may be observed through examination under a microscope—composed of tightly furled polymeric film which, incident to refining, partially unfurls or uncoils.

The ability to cast and dry fibrids having bimorphological character directly into a synthetic paper-like film is highly desirable. It has been described that a paper-like product comprising such fibrids offers a substantial advance over synthetic paper composed of particles of solely a fibril character. This is true even where both fibrids and fibrils compose the paper. Where film portions are also present in the particles composing a synthetic paper, their planar character offers a considerable improvement over products produced from essentially unidimensional fiber or fibril constituents. Apparently, however, the present fibrid combination of film and fiber morphology has not previously been transferrable to a paper or paper-like structure and thus the advantages of the present products have not been obtained in the prior art.

It is surmised that the reason for the failure of the prior art to benefit from the bimorphological character of refined polyolefin fibers lies in the fact that the customary further treatments of such fibrids have destroyed this uniquely desirable morphology. Thus, for example, it is now known that immediate exchange of water for the refining dispersant of the present fibrids, or even the more sophisticated purification techniques for such fibrids which normally include dispersing such fibrids in water only after their transfer through an intermediate, mutually miscible dispersing medium destroys the film-like character of the initial fibrids.

This destruction apparently results from the fact that direct contact of the bimorphological fibrids with water, or with other common intermediate dispersant media, causes the fibrids to recoil or refurl so as to resume their former tightly coiled fibril structure. Accordingly, incident to the prior art techniques, the present fibrids existed only as a transitory structure which was not properly appreciated.

In accordance with the present invention, however, it has been discovered that fibrids having the present combination of both film and fiber morphology can be substantially preserved in bimorphological condition. With proper treatment, they can be formed into paper-like solid fibrid films or webs. These fibrids can even be transferred into an essentially aqueous solution to facilitate the formation of these structures.

The preservation of the bimorphic fibrids is accomplished by refining i.e., treating the fibrids with a water-soluble surface-active agent having hydrophilic properties under conditions of high shear stress, e.g., the shear similar to that achievable with a Waring Blendor or like device. To facilitate treatment, the surface-active agent is desirably provided in liquid form and constitutes a protective and preservative medium in which the fibrids may be slurried.

Various polyhydric substances may be utilized as the surface-active agent. Many of these substances are normally liquid and therefore directly useful as protective and preservative media. Solid polyhydric substance may be used if they are first solubilized, for example, in water or alcohol. It has been discovered that maximum retention of the desired bimorphological characteristics is obtained through utilization of diols—such as glycol or derivatives thereof; triols—such as glycerol, etc.; and solutions of cationic starch, unmodified starch, anionic starch, polyvinyl alcohol or mixtures thereof. These preservative media are particularly useful inasmuch as they are completely compatible with—and even substantially improve—the quality of the eventual paper-like structures which are the ultimate objectives of the present invention.

Other media are also useful for retaining the bimorphic character of fibrids. These include the materials which are generally recognized as being surface-active agents such as, for example, alkyl aryl benzene sulfonates, alcohols, sulfonates and sulfates of alkyl aryl polyether, polyvinyl alcohol and rosin size.

The surface-active agents may be provided in aqueous or alcohol solutions in amounts of from about 0.0002 to 99%, more preferably 0.05 to about 15%, by weight for protective and preservative treatment of the fibrids.

Treatment of the fibrids is most conveniently accomplished through transfer of the fibrids from the refining dispersant to a preservative medium. This may be done by means customary in the art for similar transfers of solid polyolefin from one medium to another. For example, the first slurry may be drained—e.g. filtered—so as to remove refining dispersant by mechanical means, ordinarily as much as is possible if losses and contamination are to be avoided. The resultant pulp may then be redispersed under conditions of high shear stress in the protective and preservative medium.

In accordance with such techniques, it is an advantage that dispersal of the fibrid pulp in the second medium also removes by dilution, much of the refining dispersant medium which remains within the pulp. Thus, besides effecting the transfer of fibrids from one medium to another, this technique affords a substantial purification whereby undesirable contaminants, such as the refining or other previous media, may be removed from the fibrids. More important, the conditions of high shear stress serve to maintain substantially the film-fiber bipartite morphology for a sufficiently long period that the protective medium can be applied uniformly over the surfaces of the film and fiber and therewith serve to protect and preserve the bimorphic morphology.

Once treated with one of the present surface-active agents, the fibrids can be cast into paper-like substrate products through means well-known in the art. Even a slurry of fibrids in the preservative medium itself may be processed in this manner. It is desirable, however, to avoid the difficulties involved in complete removal of free preservative and similar media from a substrate product. Also, it is advantageous to utilize the most conventional processing techniques. Accordingly, the fibrids are ordinarily transferred into essentially pure water to imitate the natural pulp slurries of the prior art.

Transfer of the bimorphological fibrids from the preservative medium to an essentially aqueous one may also be accomplished in the manner previously described, or by any of the other well-known techniques for such transfer utilized by the prior art. Moreover, the present utilization of a preservative medium greatly facilitates this transfer because the fibrids retain sufficient surface-active agent to render them completely wettable. The preservative medium is retained by what is presently believed to be an adsorption mechanism and unexpectedly resolves the prior art difficulties respecting final dispersion of the bimorphic product in water.

In practicing the present process, and particularly the transfer of fibrids to an eventual essentially aqueous slurry, only one further caveat remains. As has previously been indicated, the prior art has generally recognized the desirability of performing refining of polyolefin fiber in low molecular weight organic liquids such as acetone, methanol, ethanol, propanol, isomers thereof and similar low molecular weight organic liquids, this has customarily been performed for a number of reasons, including the desire to facilitate purification of the polyolefin from the liquid hydrocarbon in which such fibers are generally formed. However, there has been no appreciation that such low molecular weight organic media can be utilized in combination with the preservatives of the present invention to successfully preserve the bimorphological properties of the fibrids of the present invention.

In accordance with certain other prior art techniques for producing synthetic pulps, however, the liquid hydrocarbon in which the initial solid polyolefin fibers are formed is also utilized as the refining dispersant. In those cases, the required transfer of fibrids to medium utilized for the protection of bimorphological character is more difficult. Because many such media—particularly those comprising liquid polyhydric substances—are not miscible with a hydrocarbon refining dispersant, direct transfer of the fibrids from liquid hydrocarbon is considered undesirable. Substantial contact between the liquid hydrocarbon and the preservative medium may result in sufficient repulsion to cause fibrids laden with such hydrocarbon to recoil or refurl into the undesirable fibril morphology, thus destroying the present preferred combination of both film and fiber morphology.

Consequently, considerable care is preferably taken to avoid the presence of substantial amounts of hydrocarbon adherent to the fibrids which are sought to be dispersed in the present preservative medium. One means by which the danger of substantial loss or bimorphological character may be avoided resides in the careful removal of hydrocarbon from the fibrids. Although this can be performed by techniques such as vacuum evaporation, etc., it is most efficatiously effected by transferring the fibrids laden with liquid hydrocarbon to a first organic solution miscible with such hydrocarbon and preferably also of at least limited miscibility with the preservative medium. The low molecular weight organic media in which polyolefin fibers are more customarily refined in the prior art constitute such suitable intermediates e.g., methanol, acetone, propanol and isomers. Thus, in accordance with this preferred embodiment of the present invention, the fibrids produced by refining of polyolefinic fiber in a hydrocarbon dispersant are transferred first to a medium mutually soluble with such hydrocarbon and the preservative medium and only then passed successively through that medium and into an essentially aqueous slurry.

Once the desired solution of the present fibrids in an essentially aqueous slurry has successfully been produced, that slurry may be utilized directly in the formation of synthetic paper and paper-like films. The casting and drying of the slurry to produce such films may be performed in accordance with the customary techniques in the art. Thus, for example, an aqueous slurry having a solids concentration of from 0.05 to 1.5%, preferably 0.3% may be deposited on a screen or processed on any standard paper machine, and there dried to form a flexible synthetic paper-like substrate. Although these slurried solids may consist solely of the present fibrids, this is not necessary. From about 0.05 to 0.2%, preferably 0.1%, of fibrids by slurry weight is sufficient to permit enjoyment of most of the advantages of this invention.

While, as noted, the technique by which the present slurries may be formed into synthetic paper or paper-like substrates is conventional, it is significant that the slurry thus processed differs substantially from the aqueous polyolefin slurries which have heretofore been successfully formed into such products. Useful high strength webs have not previously been susceptible to production under conventional paper-making conditions without the addition of adhesive-like material, chemical modification of polyolefin content or similar modification of prior art synthetic pulps.

The present utilization of an aqueous slurry containing bimorphological film and fiber fibrids, however, offers the unexpected advantage that synthetic paper or paper-like films or webs may be formed without substantial chemical modification of, or addition to, the slurry, and without loss of desirable strength characteristics in the dried product. Thus, the present fibrids exhibit an unexpected self-bonding effect which obviates the prior art need for substantial chemical modification of a synthetic polyolefin pulp.

Moreover, that self-bonding property which is apparently associated essentially with the film portion of the present fibrids, is also exhibited by the resultant synthetic films in another manner. Although the paper-like substrates formed therefrom have the same appearance as prior art papers and synthetic papers, they are easily distinguished therefrom by virtue of their lack of porosity. Thus, whereas paper-like structures made from prior art synthetic pulps or from wood pulps are composed essentially exclusively of fibril or fiber constituents, and therefore are provided with a considerable porosity between the overlapping fibrils; the present paper-like substrates additionally include the film morphology of the present fibrids. This film—which is essentially invisible and therefore not apparent—occludes the normal porosity which occurs between the fibrils and thereby render the present synthetic papers much less porous. Therefore, in accordance with the present invention, synthetic paper and paper-like substrates are produced which combine the best known properties of cellulose webs and of extruded films in a single material due to the presence of both film and fibrous areas in the present fibrids, and these desirable characteristics are not sacrificed even where other known paper or synthetic pulps of from 0-99 parts by weight per part of fibrids are used in combination with the present fibrids to produce modified products.

The invention is further illustrated by the following examples, in which all percentages—unless otherwise indicated—are on the basis of weight.

EXAMPLE 1

15 Grams of hydrocarbon-laden polyethylene fibers (1.5 grams of dry fiber) was first cut into ¼ to ½ inch lengths on a cutterboard and then placed in a Waring Blendor with 600 ml. of 91% isopropyl alcohol. A highly-swelled, generally long fibered slurry resulted. The slurry was then refined under high shear stress for 4 minutes in a Waring Blendor to yield shorter and greater swelled pulp particles. When viewed under a microscope, the particles were revealed to be fibrids containing large areas of very thin, almost invisible film attached to varying sizes of fibrils. It was evident that the particles were actually films which were only partially rolled or coiled to yield a bipartite film-fiber morphology.

Most of the alcohol was then removed from the refined slurry through vacuum filtration. The pulp was added to 600 ml. of distilled water containing 5% by weight of fiber of dissolved polyvinyl alcohol, and the resultant slurry then agitated in the Waring Blendor prior to a second vacuum filtration. The pulp resulting from this filtration was then dispersed in 600 ml. of distilled water and agitated for 1 minute in the Waring Blendor to remove residual polyvinyl alcohol. Significantly, the fibrids exhibited complete wettability in the water.

This aqueous slurry of the polyethylene fibrids was again vacuum filtered and then dispersed in distilled water to form a slurry which was 0.1% polymer. This slurry was made into a sheet of paper on a Noble and Wood sheet machine in the same manner as is normally utilized with a wood pulp. The resulting wet sheet was then pressed and dried to yield a low weight basis (34.5g/m²) sheet of synthetic paper having exceptional strength and opacity. The synthetic paper exhibited—under microscopic examination—bimorphological fibrids, the film portions of which completely occluded the normal pinhole porosity of the paper. The physical properties of that paper were as follows:

| | |
|---|---|
| Tensile strength | 1.27 kg/15 mm. Width |
| % elongation | 13.6% |
| TEA (Tensile Energy Absorption | 13359* 8.91 kg-m/m² |
| Basis weight | 34.5 g/m² |

*TEA readout from Thwing-Albert Electronic Tensile Testor Model QC using 4 inch long strip, 15 mm. wide, elongation rate = 1 inch/min. 20 kg. load cell.

EXAMPLE 2

The process of Example 1 was repeated with the change that, in place of the aqueous polyvinyl alcohol preservative solution, there was utilized an aqueous solution containing 8.0 percent of cationic starch and 2.0 percent of polyvinyl alcohol.

Again, the resultant synthetic paper exhibited—under microscopic examination—bimorphological fibrids, the film portions of which completely occluded the normal pinhole porosity of the paper. Moreover, the somewhat mottled appearance of paper products which had been produced pursuant to preservation with only an aqueous polyvinyl alcohol solution was apparently overcome by the present cationic startch co-ingredient.

The physical properties of that paper were as follows:

| | |
|---|---|
| Basis weight | 36.9 g/m$^2$ |
| Tensile strength | 2.27 kg/15 mm. width |
| % elongation | 48.1% |
| TEA | 86405* |
| | 57.60 kg-m/m$^2$ |

*See Example 1.

EXAMPLE 3

12.5 Grams hydrocarbon-laden polyethylene fibers of 18% polymer solids were cut into ¼ to ½ inch lengths, dispersed in 600 ml. of isopropyl alcohol, and refined in a Waring Blendor for 2 minutes. The resultant slurry was then vacuum filtered, redispersed in a second aliquot of 600 ml. of isopropyl alcohol and then re-refined for 2 more minutes.

10 ml. of the above slurry were withdrawn as Sample 1, diluted with 40 more grams of isopropyl alcohol and two drops thereof, deposited onto a slide. Examination under a microscope revealed numbers of fine fibrids which were characterized by the combination of both film and fiber morphology. These fibrids had the appearance of large ribbons which were partially furled so as also to yield a fiber portion.

The remaining 590 ml. of the slurry was divided into two equal volumes, each of which was separately vacuum filtered. The pulp resulting from the first volume was refined in 600 ml. of distilled water in the Waring Blendor (at this stage, it is noted that the fiber floated above the surface of the water and was not wetted), and then vacuum filtered. A small amount of the pulp was dispersed with a stirring rod in 20 ml. of isopropyl alcohol with agitation and a second slide made therefrom. Microscope examination of this slide showed essentially complete loss of the ribbon or film-like character of the original fibrids. Apparently, the fibrids reverted to a tightly coiled form.

The second volume of isopropyl alcohol refined pulp was dispersed in 600 ml. of cationic starch solution (10% based on fiber) and refined in the Waring Blendor for 1 minute. The excess cationic starch was removed by vacuum filtration and the resulting pulp, refined in the Waring Blendor with 600 ml. aliquots of water. A small portion of the washed pulp was then removed and slurried in 20 ml. of water in order to prepare a third scale. Microscopic examination revealed that the bimorphological character of the fibrids was only slightly diminished. Thus these fibers continued to exhibit substantial portions of both fibril and film character.

The remaining cationic starch-treated pulp was slurried in 600 ml. of water and vacuum filtered to remove cationic starch. The washed pulp was then formed into paper in the same manner utilized in Example 1. The resultant synthetic paper exhibited exceptional wet strength and low-porosity. Its physical characteristics were as follows:

| | |
|---|---|
| Tensile strength | 1.31 kg/15 mm. width |
| % elongation | 19.0% |
| TEA | 22242* |
| | 14.83 kg-m/m$^2$ |
| Basis weight | 33.5 g/m$^2$ |

*See Example 1.

An additional and most desirable characteristic of the paper produced from the synthetic pulp in accordance with the invention is that it is recyclable paper and that in accordance with the art it can be chopped or shredded into pieces of conventional dimensions, redispersed or slurried in water and reused per se or in admixture with other synthetic or wood pulp sources to form sheets of paper having desirable properties.

EXAMPLE 4

15 Grams of hydrocarbon-laden polyethylene-polypropylene fibers (1.5 grams of dry fiber) was first cut into ¼ to ½ inch lengths on a cutterboard and then placed in a Waring Blendor with 600 ml. of 91% isopropyl alcohol. A highly-swelled, generally long fibered slurry resulted. The slurry was then refined under high shear stress for 4 minutes in a Waring Blendor to yield shorter and greater swelled pulp particles. When viewed under a microscope, the particles were revealed to be fibrids containing large areas of very thin, almost invisible film attached to varying sizes of fibrils. It was evident that the particles were actually films which were only partially rolled or coiled to yield a bipartite film-fiber morphology.

Most of the alcohol was then removed from the refined slurry through vacuum filtration. The pulp was then added to 600 ml. of distilled water containing 0.2% by weight of alkyl aryl benzene sulfonate. The resultant slurry was agitated in the blender until thoroughly mixed and then slides were prepared from samples of the slurry and the slides clearly indicated that the desirable film-fiber morphology had been maintained. It was most apparent that the pulp was tightly adhered to the glass slide.

I claim:

1. A method for producing synthetic wood pulp comprising refining solid polyolefin fiber in a low molecular weight organic liquid dispersant, miscible both with liquid hydrocarbon and water, under conditions of high shear stress for a period of time sufficient to produce fibrids characterized by having the combination of both film and fiber morphology and treating said fibrids with a preservative medium comprising a water-soluble surface active agent having hydrophilic properties under conditions of high shear stress sufficient substantially to displace said dispersant and to preserve the film and fiber morphology of said fibrids.

2. The method of claim 1 wherein the surface-active agent comprises a substance selected from the group consisting of alkyl aryl sulfonates, aliphatic and alicyclic diol, aliphatic and alicyclic triol and carbohydrate saccharide and polysaccharide and polyvinyl alcohol.

3. The method of claim 1, wherein the preservative medium comprises an aqueous or alcohol solution containing from about 0.0002 to 99% by weight of surface-active agent.

4. The method of claim 3, wherein the solution contains from 0.05 to 15% by weight of surface-active agent.

5. The method of claim 4, wherein the surface-active agent comprises polyvinyl alcohol.

6. A method for producing synthetic wood pulp comprising refining solid polyolefin fiber in liquid hydrocarbon dispersant under conditions of high shear stress for a period of time sufficient to produce fibrids characterized by having a combination of both film and fiber morphology, exchanging said fibrids into a low molecular weight organic liquid, miscible both with said hydrocarbon and water, and then treating said fibrids with a preservative medium comprising a water-soluble, surface active agent having hydrophilic properties under conditions of high shear stress sufficient substantially to displace said dispersant and to preserve the film and fiber morphology of said fibrids.

7. The method of claim 6, wherein the surface-active agent comprises a substance selected from the group consisting of alkyl aryl sulfonates, aliphatic and alicyclic diol, aliphatic and alicyclic triol, carbohydrate saccharide and polysaccharide and polyvinyl alcohol.

8. The method of claim 6, wherein the preservative medium comprises an aqueous or alcohol solution containing from about 0.002 to 99% by weight of surface-active agent.

9. The method of claim 8, wherein the solution contains from 0.05 to 15% by weight of surface-active agent.

10. The method of claim 9, wherein the surface-active agent comprises polyvinyl alcohol.

* * * * *